US010850909B2

(12) United States Patent
Oleti

(10) Patent No.: US 10,850,909 B2
(45) Date of Patent: Dec. 1, 2020

(54) DISPOSABLE INGREDIENT-DISPENSING APPARATUS

(71) Applicant: Sunil Oleti, Cumming, GA (US)

(72) Inventor: Sunil Oleti, Cumming, GA (US)

( * ) Notice: Subject to any disclaimer, the term of this patent is extended or adjusted under 35 U.S.C. 154(b) by 98 days.

(21) Appl. No.: 15/910,140

(22) Filed: Mar. 2, 2018

(65) Prior Publication Data

US 2018/0251287 A1 Sep. 6, 2018

Related U.S. Application Data

(60) Provisional application No. 62/465,865, filed on Mar. 2, 2017.

(51) Int. Cl.
*B65D 25/08* (2006.01)
*B65D 51/24* (2006.01)
*B65D 81/32* (2006.01)

(52) U.S. Cl.
CPC ..... *B65D 81/3238* (2013.01); *B65D 25/08* (2013.01); *B65D 51/24* (2013.01)

(58) Field of Classification Search
CPC .... B65D 25/08; B65D 25/085; B65D 25/087; B65D 51/285; B65D 51/2814; B65D 51/2821; B65D 51/2828; B65D 51/2835; B65D 51/2842; B65D 51/2857; B65D 51/2864; B65D 51/2871; B65D 51/2878; B65D 51/2885; B65D 51/2892; B65D 81/3233; B65D 81/3238; B65D 81/3244; B65D 81/3261; B65D 81/3266; B65D 81/3277
USPC ..... 206/219, 220, 221, 222
See application file for complete search history.

(56) References Cited

U.S. PATENT DOCUMENTS 4,785,931 A * 11/1988 Weir ..... B65D 51/2835 206/222
5,035,320 A * 7/1991 Plone ..... A47G 21/004 206/219
5,529,179 A * 6/1996 Hanson ..... B65D 51/2821 206/217
5,979,647 A * 11/1999 Han ..... B65D 51/2828 206/222
6,338,252 B1 * 1/2002 Calderaio ..... A47J 36/28 126/263.08
6,564,934 B1 * 5/2003 Dischler ..... B65D 51/2828 206/219
6,938,768 B2 * 9/2005 Ferretti ..... B65D 43/0212 116/307

(Continued)

*Primary Examiner* — Joshua E Rodden

(57) ABSTRACT

A disposable ingredient-dispensing apparatus selectively dispenses one or more ingredients. The disposable ingredient-dispensing apparatus includes a substantially circular base member comprising multiple chambers circumferentially positioned along the base member, and a ring frame configured to be rotatable circumferentially along a surface of the base member. Each chamber is filled with the one or more ingredients, and is sealed with a diaphragm. The ring frame comprises a rupturing member positioned at a predefined section of the ring frame, and the ring frame is rotated to selectively align the rupturing member to enclose one of the chambers, and the rupturing member contacts the aligned chamber to rupture the diaphragm for selectively dispensing the ingredients.

2 Claims, 15 Drawing Sheets

(56) References Cited

U.S. PATENT DOCUMENTS

| | | | | |
|---|---|---|---|---|
| 7,681,726 | B2 * | 3/2010 | O'Donnell | B65D 51/2828 206/222 |
| 8,453,833 | B2 * | 6/2013 | Porter | B65D 51/2871 206/222 |
| 8,453,834 | B2 * | 6/2013 | Porter | B65D 51/2871 206/222 |
| 8,662,294 | B2 * | 3/2014 | Benbassat | B65D 81/3205 206/222 |
| 2002/0066680 | A1 * | 6/2002 | Stern | B65D 47/38 206/222 |
| 2005/0284302 | A1 * | 12/2005 | Levin | B65D 51/2828 99/275 |
| 2009/0120815 | A1 * | 5/2009 | Mitchell | B65D 51/2821 206/222 |
| 2010/0000887 | A1 * | 1/2010 | Troesch | B65D 51/2821 206/219 |
| 2015/0360844 | A1 * | 12/2015 | Frieden | B65D 81/3211 206/222 |
| 2016/0031598 | A1 * | 2/2016 | Rose | B65D 25/08 215/390 |
| 2016/0068319 | A1 * | 3/2016 | Friesen | B65D 51/2835 206/222 |

* cited by examiner

DISPOSABLE INGREDIENT-DISPENSING APPARATUS

CROSS-REFERENCE TO RELATED APPLICATION

This application claims priority to the US Patent Application No. 62/465,865 filed on 2 Mar. 2017 in the United State Patent and Trademark Office. The specification of the above referenced patent application is incorporated herein by reference in its entirety.

A. TECHNICAL FIELD

The present invention generally relates to dispensing apparatus configured on lids or cups. More particularly, the invention disclosed herein relates to a disposable ingredient-dispensing lid and a disposable ingredient-dispensing cup containing similar or different ingredients for selectively dispensing ingredients stored within the disposable ingredient-dispensing lid or disposable ingredient-dispensing cup respectively.

B. DESCRIPTION OF RELATED ART

Traditionally, multi-chambered containers having hinged lids are used in the sample testing industry. These lids can have multiple filling ports, typically one for each chamber of a container. Further, such lids are molded out of a polymer material, and then secured to a container, e.g. by ultrasonic welding. The unique physical properties and user requirements for such multi-chambered lid apparatus has resulted in difficulties, both in the manufacture and use thereof.

In conventional methods, the multi-chambered lid or cup disperses the contents contained in the lid by aligning channels with the drinking compartments of the container. Further, conventional multi-chambered containers use more materials and may not be suitable for disposing the container. The user should fill the ingredients in the multi-chambered lid and while filling the lid, it can cause the user to spill out the essential ingredients and lead to inconvenience to the user. Furthermore, the non-airtight design of the seal and non-isolation of the ingredients with the airtight seal would lead to moisture or contamination of the ingredients. The ingredients are dispensed by gravity or shaking to empty the ingredients, which is a limited feature to the user. Further, conventional methods require opening for content dispersal, and in turn reduces the surface area used for mixable content storage. The design does not allow stacking on each other for storage. Hence, there is a need for a disposable ingredient-dispensing apparatus, which stores multiple ingredients and provides ease to rupture or dispense the contents into a container.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor it is intended for determining the scope of the claimed subject matter.

The disposable ingredient-dispensing apparatus disclosed here selectively dispenses one or more ingredients. The disposable ingredient-dispensing apparatus comprises a substantially circular base member comprising multiple chambers circumferentially positioned along the base member, and a ring frame configured to be rotatable circumferentially along a surface of the base member. Each chamber is filled with the one or more ingredients, and is sealed with a diaphragm. The ring frame comprises a rupturing member positioned at a predefined section of the ring frame, and the ring frame is rotated to selectively align the rupturing member to enclose one of the chambers. The rupturing member contacts the aligned chamber to rupture the diaphragm for selectively dispensing the ingredients.

A first embodiment of the disposable ingredient-dispensing apparatus is a disposable ingredient-dispensing lid for a container. In this embodiment, the base member is a lid, and the ring frame is a rotatable ring element. In an embodiment, the present invention discloses the lid with multiple chambers to store the ingredients. The ingredients stored can be different or same in each chamber.

In an embodiment, the ingredients are sealed by a diaphragm of the chamber. In an embodiment, the diaphragm is dome-shaped for easy rupturing of the diaphragm. In an embodiment, the rupturing member comprises a rupturing arm housing a sliding element. In an embodiment, the diaphragm is ruptured by the sliding element of the rupturing arm mounted to a hub of the base member. In an embodiment, the rotatable ring element can be rotated on the base member to selectively enclose one of the chambers. The sliding element is then slid to rupture the diaphragm and dispense the ingredients into the container. In another embodiment, the rupturing member comprises a rupturing knob mounted to a rotatable ring element, and the diaphragm is ruptured by the rupturing knob mounted to the rotatable ring element. In an embodiment, the rotatable ring element can be rotated on the cup to selectively enclose one of the chambers. The rupturing knob is then fastened to rupture the diaphragm and dispense the ingredients into the container.

A second embodiment of the disposable ingredient-dispensing apparatus is a disposable ingredient-dispensing cup. In this embodiment, the base member is a cup, and the ring frame is a rotatable ring element. In an embodiment, the cup with multiple chambers on the sidewall of the cup to store the ingredients is disclosed. The ingredients stored can be different or same in each chamber.

In an embodiment, the ingredients are sealed by a diaphragm of the chamber. In an embodiment, the diaphragm is dome-shaped for easy rupturing of the diaphragm. In an embodiment, the rupturing member comprises a sliding element of a rupturing arm radiating from the lower rotatable ring element to join the upper rotatable ring element, and the diaphragm is ruptured by the sliding element. In an embodiment, the rotatable ring element can be rotated on the sidewall of the cup to selectively enclose one of the chambers. The sliding element is then slid to rupture the diaphragm and dispense the ingredients into the cup.

In alternative embodiment, the rupturing member comprises a rupturing knob mounted to a rotatable ring element, and the diaphragm is ruptured by the rupturing knob mounted to the rotatable ring element. In an embodiment, the rotatable ring element can be rotated on the cup to selectively enclose one of the chambers. The rupturing knob is then fastened to rupture the diaphragm and dispense the ingredients on the sidewall of the cup into the cup. In another embodiment, the rupturing knob is a fixed knob.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figure 1:
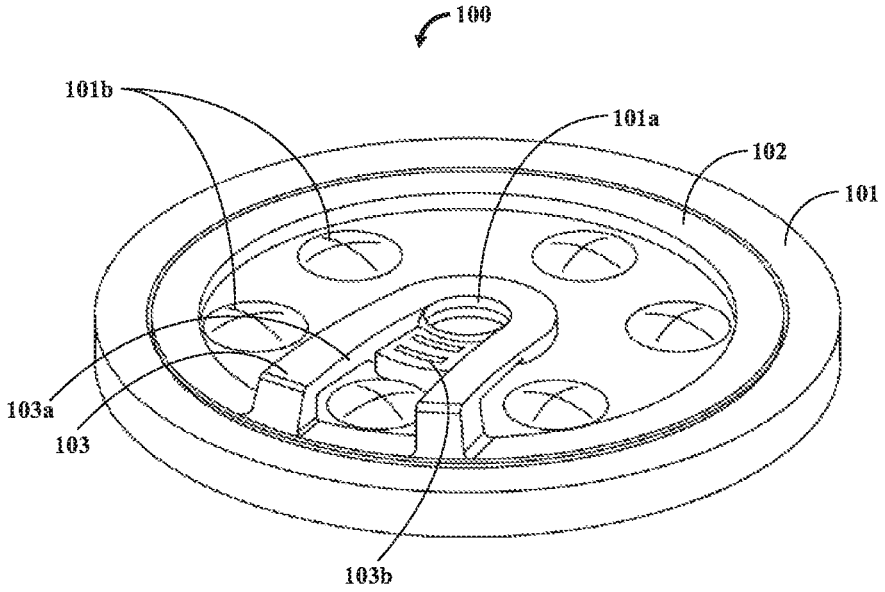
FIG. 1 is a perspective view, illustrating a disposable ingredient-dispensing lid along with rupturing arm, incorporating the aspects of the present embodiment.

FIG. 1 is the perspective view, illustrating the disposable ingredient-dispensing lid 100 along with rupturing arm 103, according to the embodiment as disclosed herein. In an embodiment, the disposable ingredient-dispensing lid 100 comprises a base member 101, a rotatable ring element 102, and a rupturing arm or rupturing member 103. The base member 101 comprises a hub 101*a* and multiple chambers 101*b*. Each chamber 101*b* is filled with the one or more ingredients 101*c* as exemplarily illustrated in FIGS. 2-3. Each chamber 101*b* is sealed with a diaphragm 104 as exemplarily illustrated in FIGS. 2-3. The rotatable ring element 102 is mounted on the hub 101*a* of the base member 101 via a rupturing arm 103 radially extending from the hub 101*a* of the base member 101 to join the rotatable ring element 102. The rupturing arm 103 comprises a groove 103*a* and a sliding element 103*b*. The rotatable ring element 102 is rotated to selectively align the rupturing arm 103 with one of the chambers 101*b*, to enclose the aligned chamber 101*b* within the groove 103*a*. The sliding element 103*b* seated in the groove 103*a* is slid from the hub 101*a* of the base member 101 towards the rotatable ring element 102 to rupture the diaphragm 104 for selectively dispensing the one or more ingredients 101*c*, as further explained in FIG. 2.

Figure 2:
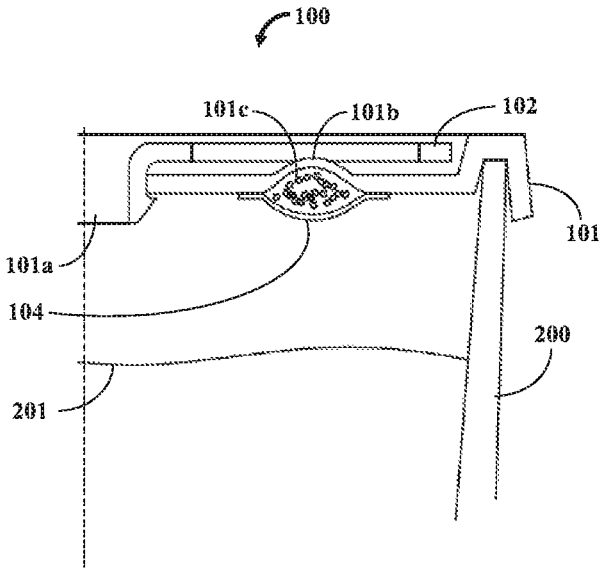
FIG. 2 is a sectional view, illustrating a container along with the disposable ingredient-dispensing lid, incorporating the aspects of the present embodiment.

FIG. 2 is a sectional view, illustrating a container 200 along with the disposable ingredient-dispensing lid 100, according to the embodiment as disclosed herein. In an embodiment, the ingredients 101*c* are, for example, a powdered form, a paste form, etc., and not limited to these compositions. In an embodiment, each chamber 101*b* is filled with ingredients 101*c* at the time of fabrication of the disposable ingredient-dispensing lid 100. The chambers 101*b* are sealed with the diaphragm 104 after filling the ingredients inside the chamber 101*b*. In an embodiment, the diaphragm 104 is made of, for example, a thin, easily rupture-able material. In an embodiment, the base member 101 is non-reusable and also disposable. The diaphragm 104 can be any suitable material for sealing the ingredients. The diaphragm 104 is an airtight seal that does not allow moisture to enter or contaminate the ingredients 101*c*. In another embodiment, the diaphragm 104 is dome shaped. The dome shape ensures that the ingredients 101*c* in the chamber 101*b* are dispensed completely into the container 200 without the need of a shaking action.

In an embodiment, the rotatable ring element 102 is mounted on the hub 101*a* of the base member 101 of the disposable ingredient-dispensing lid 100. The rotatable ring element 102 rotates within the base member 101 of the disposable ingredient-dispensing lid 100 for aligning the rupturing arm 103, exemplarily illustrated in FIG. 1, with the desired chamber 101*b*. In a preferred embodiment, the rupturing arm 103 ruptures the diaphragm 104 for dispensing the ingredients 101*c* contained in the chamber 101*b* to a container 200 attached to the disposable ingredient-dispensing lid 100. In an example, the container 200 is a cup, beverage container, medicine container, etc. The container 200 contains a liquid 201 such as beverage, medicine, syrup, concentrated liquid, juice, etc.

Figure 3:
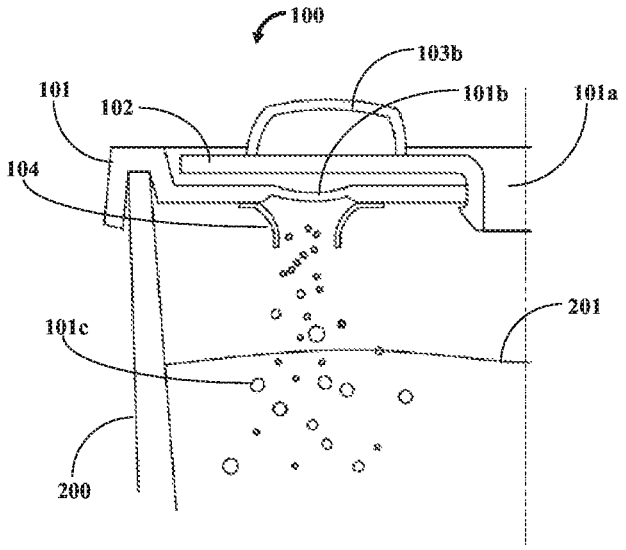
FIG. 3 is a sectional view, illustrating a disposable ingredient-dispensing lid dispensing one or more ingredients into a container, incorporating the aspects of the present embodiment.

FIG. 3 is a sectional view, illustrating a disposable ingredient-dispensing lid 100 dispensing one or more ingredients 101*c* into a container 200, according to the embodiments as disclosed herein. The disposable ingredient-dispensing lid 100 includes the rotatable ring element 102. In an embodiment, the diaphragm 104 is ruptured by applying force or pressing the sliding element 103*b* in a forward direction towards chamber 101*b*. In another embodiment, the dome shaped diaphragm 104 is filled with air or the like to ensure rupturing. Once the chamber 101*b* is pressed, the diaphragm 104 ruptures and ensures that all the ingredients 101*c* of the chamber 101*b* are dispensed into the container 200. In an embodiment, the design of the disposable ingredient-dispensing lid 100 is substantially flat and allows stacking into much denser columns. This allows the disposable ingredient-dispensing lid 100 to be of a disposable nature and consumes a reduced shelf space. Further, the design of the disposable ingredient-dispensing lid 100 is such that it disperses the ingredients 101*c* by a sliding pressure applied with the sliding element 103*b*. A similar method of applying mechanical pressure to force open the sealed chamber 101*b* may be used.

The chambers 101*b* are pre-filled with the ingredients 101*c* during production. Furthermore, airtight sealing and isolation of the mixable ingredients 101*c* ensures prevention from moisture damage or other contaminations. The mechanism for dispersal results in a complete emptying of the mixable ingredients 101*e*. The design allows for the whole of the base member 101 of the disposable ingredient-dispensing lid 100 to be used for storage of the ingredients 101*c*. In addition, the opening mechanism performed by the rotatable ring element 102 has a unique rotatable action which is substantially different than conventional methods of rotation. In some implementations, the disposable ingredient-dispensing lid 100 and the container 200 can be of any shape and size and allows fitting any other container 200. In an embodiment, the container 200 contains a liquid 201 such as beverage, medicine, syrup, concentrated liquid, juice, etc.

Figure 4:
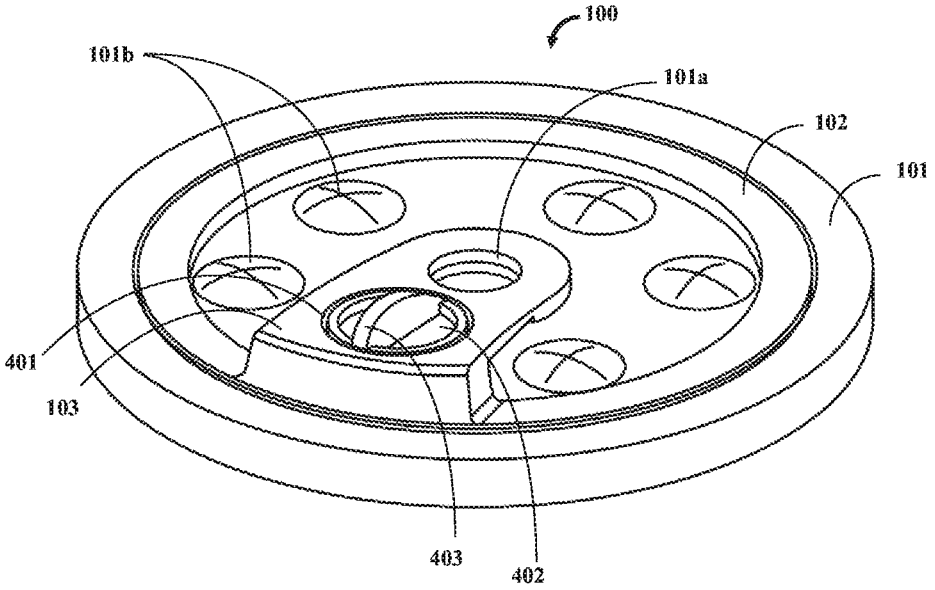
FIG. 4 is a perspective view, illustrating a disposable ingredient-dispensing lid along with rupturing knob, incorporating the aspects of the present embodiment.

FIG. 4 is the perspective view, illustrating the disposable ingredient-dispensing lid 100 along with rupturing knob or rupturing member 103, according to the embodiment as disclosed herein. In an embodiment, the disposable ingredient-dispensing lid 100 comprises a base member 101, a rotatable ring element 102, and a rupturing knob 402. The base member 101 comprises a hub 101*a* and multiple chambers 101*b*. Each of the chambers 101*b* is filled with the one or more ingredients 101*c* as exemplarily illustrated in FIGS. 2-3. Each chamber 101*b* is sealed with a diaphragm 104 as exemplarily illustrated in FIGS. 2-3. The rotatable ring element 102 is mounted on the hub 101*a* of the base member 101 via a rupturing knob 402 radiating from the hub 101*a* of the base member 101 to join the rotatable ring element 102. The rupturing knob 402 comprises a screw thread 401 (threads are not shown) and a finger grip element 403. The rotatable ring element 102 is rotated to selectively align the rupturing knob 402 above the chamber 101*b* to enclose one of the chambers 101*b*. The rupturing knob 402 seated in the screw thread 401 is fastened towards the chamber 101*b* using the finger grip element 403 to rupture the diaphragm 104 for selectively dispensing one or more of the ingredients 101*c*.

Figure 5A:
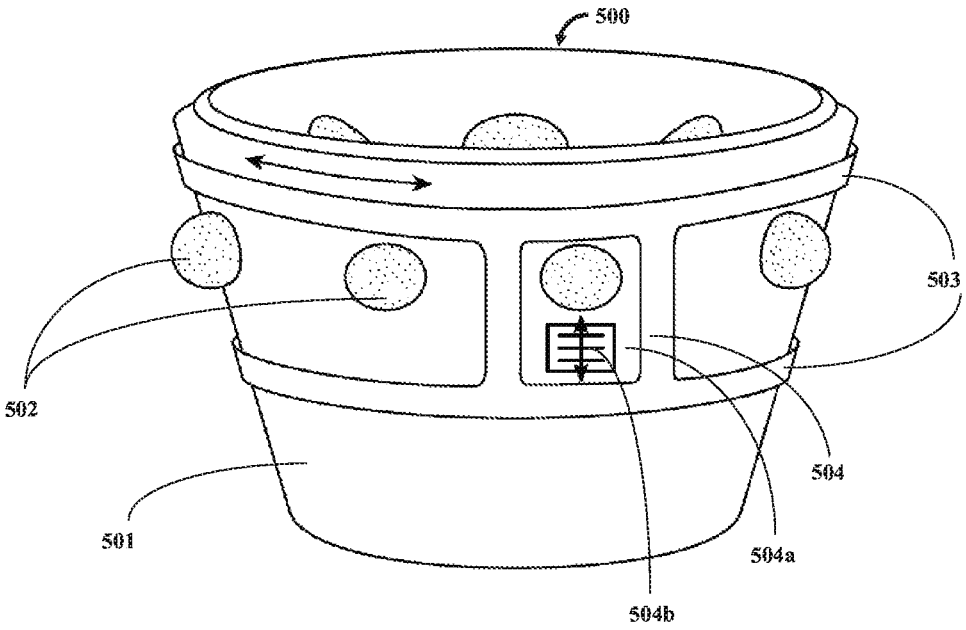
FIG. 5A is a perspective view, illustrating a disposable ingredient-dispensing cup along with rupturing arm, incorporating the aspects of the present embodiment.

FIG. 5A is the perspective view, illustrating the disposable ingredient-dispensing cup 500 along with rupturing arm or rupturing member 504, according to the embodiment as disclosed herein. In an embodiment the disposable ingredient-dispensing cup 500 allows to selectively dispense one or more ingredients 101*c* similarly as exemplarily illustrated in FIGS. 2-3. In an embodiment, the disposable ingredient-dispensing cup 500 comprises a sidewall 501 and the sidewall 501 comprises multiple chambers 502. In an embodiment, each chamber 502 is filled with one or more ingredients 101*c* as exemplarily illustrated in FIGS. 2-3, and each chamber 502 is sealed with a diaphragm 104 similarly as exemplarily illustrated in FIGS. 2-3. In another embodiment, the disposable ingredient-dispensing cup 500 comprises a rotatable ring element 503 having at least one of an upper ring and a lower ring. In an embodiment, the rotatable ring element 503 is mounted on the sidewall 501 of the cup 500 via a rupturing arm 504 radiating from the lower rotatable ring element to join the upper rotatable ring element. In another embodiment, the rupturing arm 504 comprises a groove 504*a* and a sliding element 504*b*. The rotatable ring element 503 is rotated to selectively align the rupturing arm 504 to enclose one of the chambers 502 within the groove 504*a*. In an embodiment, the sliding element 504*b* seated in the groove 504*a* is slid from the lower rotatable ring element to the upper rotatable ring element to rupture the diaphragm 104 similarly as exemplarily illustrated in FIGS. 2-3, for selectively dispensing one or more ingredients 101*c* from the sidewall 501 into to the cup 500.

Figure 5B:
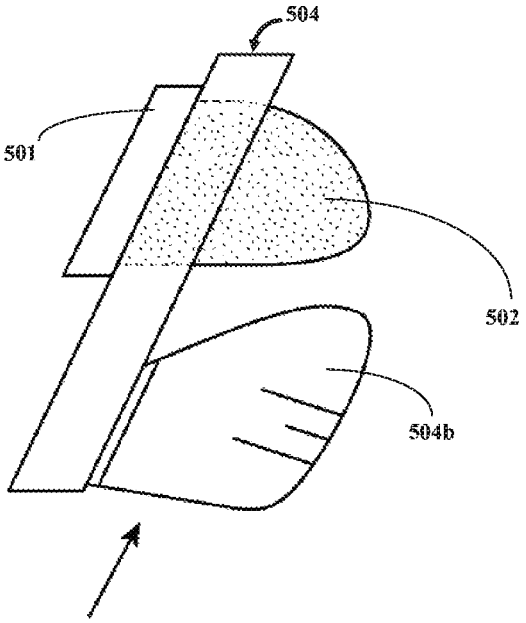
FIG. 5B is a sectional view, illustrating the rupturing arm and chamber corresponding to the disposable ingredient-dispensing cup, incorporating the aspects of the present embodiment.

FIG. 5B is the sectional view, illustrating the rupturing arm 504 and chamber 502 corresponding to the disposable ingredient-dispensing cup 500, according to the embodiment as disclosed herein. In an embodiment, the sidewall 501 comprises multiple chambers 502, and each chamber is sealed with a diaphragm 104 as exemplarily illustrated in FIGS. 2-3. In an embodiment, the rotatable ring element 503 is rotated to selectively align the rotatable ring element 503 to enclose one of the chambers 502 within the groove 504*a* of the rupturing arm 504. In an embodiment, the sliding element 504*b* is further slid in upward direction from the lower rotatable ring element to upper rotatable ring element of the rotatable ring element 503. The disposable ingredient-dispensing cup 500 allows rupturing the diaphragm 104 of the enclosed chamber 502 and dispenses the ingredients from the enclosed chamber.

Figure 6:
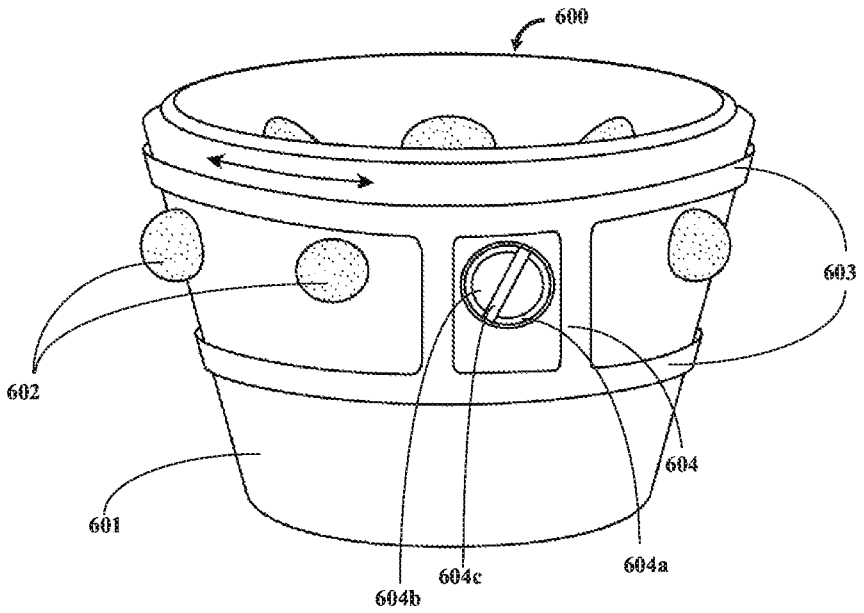
FIG. 6 is a perspective view, illustrating a disposable ingredient-dispensing cup along with rupturing knob, incorporating the aspects of the present embodiment.

FIG. 6 is the perspective view, illustrating the disposable ingredient-dispensing cup 600 along with rupturing knob or rupturing member 604*b*, according to the embodiments as disclosed herein. In an embodiment, the disposable ingredient-dispensing cup 600 allows to selectively dispense one or more ingredients 101*c*, similarly as exemplarily illustrated in FIGS. 2-3. In an embodiment, the disposable ingredient-dispensing cup 600 comprises a sidewall 601 and the sidewall 601 comprises multiple chambers 602. In an embodiment, each chamber 602 is filled with the one or more ingredients 101*c*, similarly as exemplarily illustrated in FIGS. 2-3, and each chamber 602 is sealed with a diaphragm 104 similarly as exemplarily illustrated in FIGS. 2-3. In another embodiment, the disposable ingredient-dispensing cup 600 comprises a rotatable ring element 603 having at least one of an upper ring and a lower ring. In one embodiment, the rotatable ring element 603 is mounted on the sidewall 601 of the cup 600 via a rupturing knob 604*b* between the lower rotatable ring element and the upper rotatable ring element of the rupturing arm 604. The rupturing knob 604*b* comprises a screw thread 604*a* and a finger grip element 604*c*, and the rotatable ring element 603 is rotated to selectively align the rupturing knob 604*b* to enclose one of the chambers 602 underneath the rupturing knob 604*b*. In an embodiment, the rupturing knob 604*c* is seated in the screw thread 604*a*, and rotating the rupturing knob 604*c* using a finger grip element 604*c* ruptures the diaphragm 104, similarly as exemplarily illustrated in FIGS. 2-3. The rupturing of the diaphragm 104 selectively dispenses the ingredients 101*c* from the sidewall 601 into to the cup 600.

Figure 7:
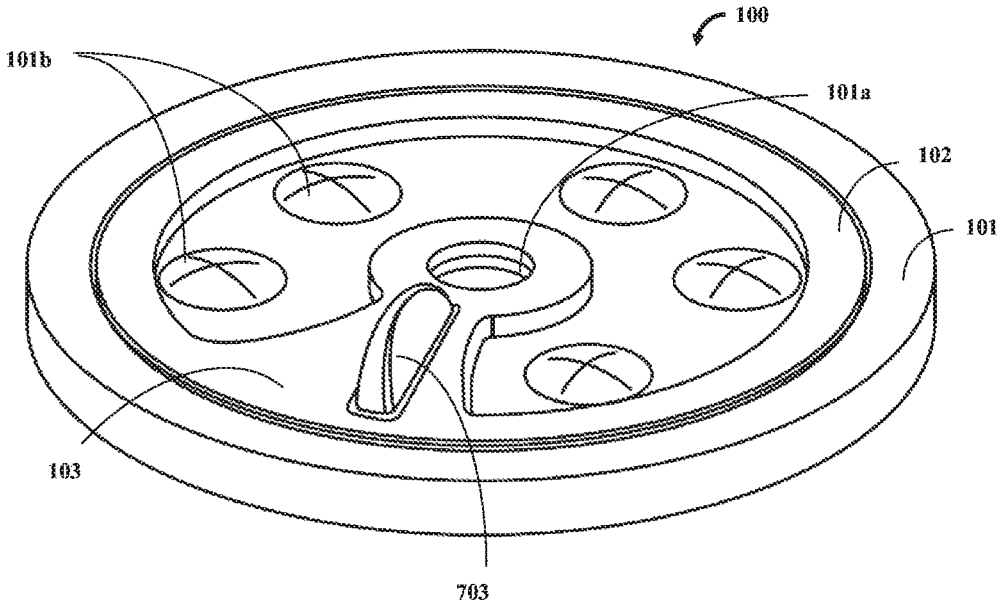
FIG. 7 is a perspective view, illustrating a disposable ingredient-dispensing lid along with fixed knob, incorporating the aspects of the present embodiment.

FIG. 7 is the perspective view, illustrating the disposable ingredient-dispensing lid 100 along with fixed knob or rupturing member 703, according to the embodiment as disclosed herein. In an embodiment, the disposable ingredient-dispensing lid 100 comprises a base member 101, a rotatable ring element 102, and a fixed knob 703. The base member 101 comprises a hub 101*a* and multiple chambers 101*b*. Each of the chambers 101*b* is filled with the one or more ingredients 101*c* as exemplarily illustrated in FIGS. 2-3. Each chamber 101*b* is sealed with a diaphragm 104 as exemplarily illustrated in FIGS. 2-3. The rotatable ring element 102 is mounted on the hub 101*a* of the base member 101 via a fixed knob 703 radiating from the hub 101*a* of the base member 101 to join the rotatable ring element 102. The rotatable ring element 102 is rotated by moving the fixed knob 703 to align the fixed knob 703 above the chamber 101*b* to rupture the diaphragm 104 for dispensing one or more of the ingredients 101*c* from the enclosed chamber 101*b*, as shown in FIG. 3. Here, in this design, the fixed knob 703 is configured to rupture the diaphragm 104 in the chamber 101*b* sequentially.

Figure 8:
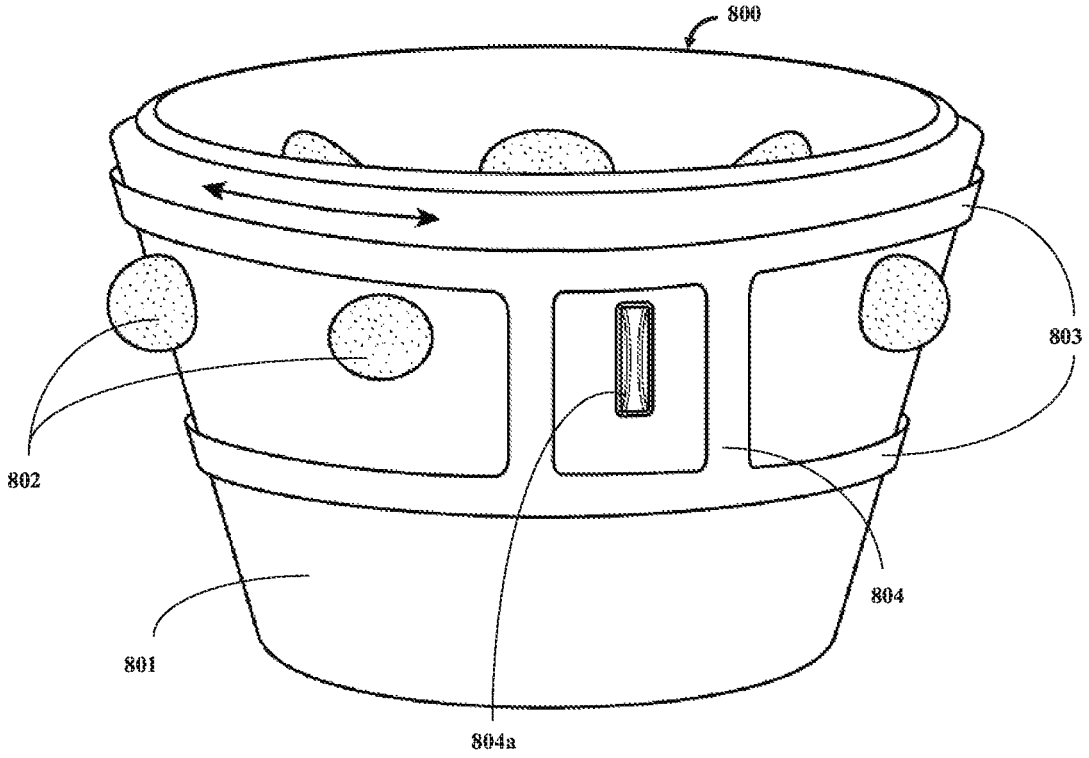
FIG. 8 is a perspective view, illustrating a disposable ingredient-dispensing cup along with fixed knob, incorporating the aspects of the present embodiment.

FIG. 8 is the perspective view, illustrating the disposable ingredient-dispensing cup 800 along with fixed knob or rupturing member 804*a*, according to the embodiments as disclosed herein. In an embodiment, the disposable ingredient-dispensing cup 800 allows to dispense one or more ingredients 101*c*, similarly as exemplarily illustrated in FIGS. 2-3. In an embodiment, the disposable ingredient-dispensing cup 800 comprises a sidewall 801. In another embodiment, the sidewall 801 is incorporated with multiple chambers 802. In an embodiment, each chamber 802 is filled with the one or more ingredients 101*c*, similarly as exemplarily illustrated in FIGS. 2-3, and each chamber 802 is sealed with a diaphragm 104 similarly as exemplarily illustrated in FIGS. 2-3. In another embodiment, the disposable ingredient-dispensing cup 800 comprises a rotatable ring element 803 having at least one of an upper ring and a lower ring. In one embodiment, the rotatable ring element 803 is mounted on the sidewall 801 of the cup 800 via a fixed knob 804*a* between the lower rotatable ring element and the upper rotatable ring element of the rupturing arm 804. The rotatable ring element 803 is rotated by moving the fixed knob 703 to align the fixed knob 703 above the chamber 101*b* to rupture the diaphragm 104 for dispensing one or more of the ingredients 101*c* from the enclosed chamber 101*b*, as shown in FIGS. 2-3. Here, in this design, the fixed knob 703 is configured to rupture the diaphragm 104 in the chamber 101*b* sequentially. The rupturing of the diaphragm 104 dispenses the ingredients 101*c* from the sidewall 801 into the cup 800.

Figure 9:
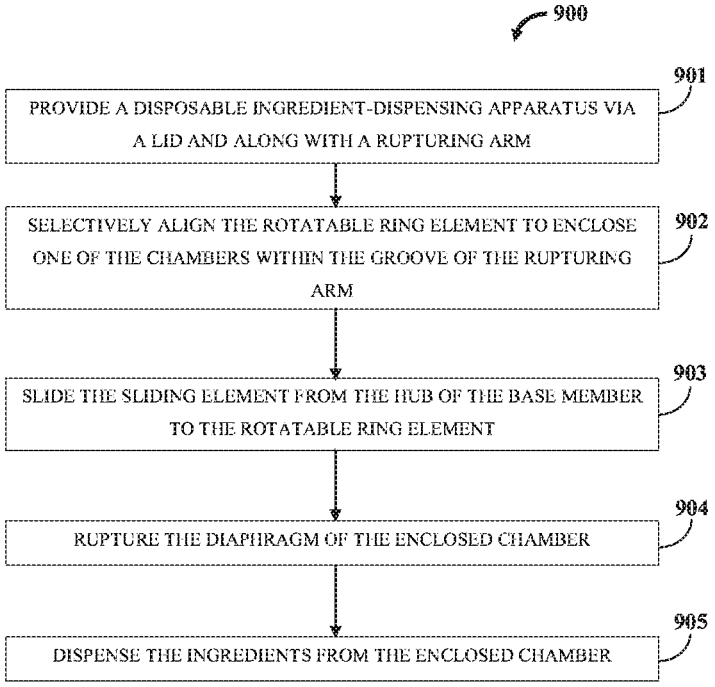
FIG. 9 illustrates a method for selectively dispensing one or more ingredients via a dispensing lid along with the rupturing arm.

FIG. 9 illustrates the method 900 for selectively dispensing one or more ingredients via the lid and along with the rupturing arm or rupturing member. In Step 901, a disposable ingredient-dispensing lid comprising a base member, a rotatable ring element, is provided. In Step 902, the rotatable ring element is selectively aligned to enclose one of the chambers within the groove of the rupturing arm. In Step 903, the sliding element is slid from the hub of the base member to the rotatable ring element. In Step 904, the diaphragm of the enclosed chamber is ruptured. In Step 905, the one or more ingredients from the enclosed chamber are dispensed.

Figure 10:
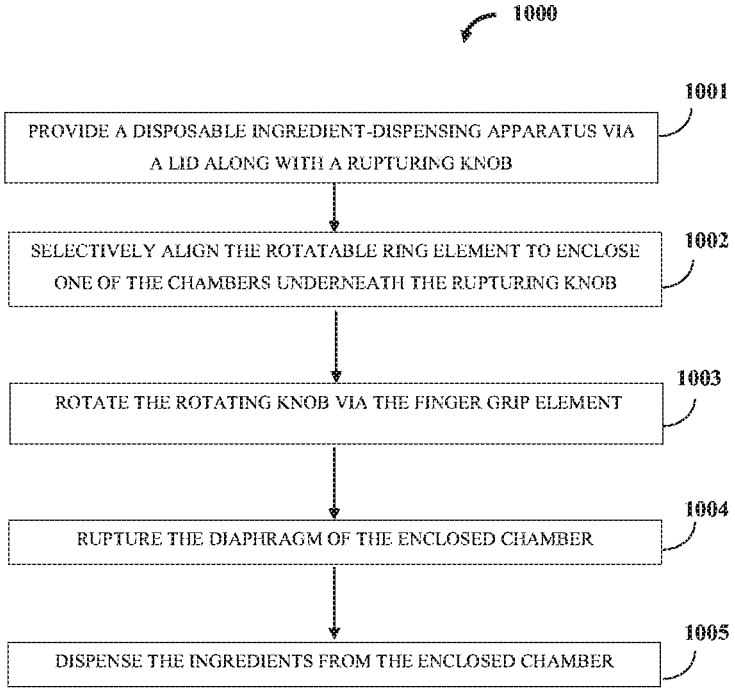
FIG. 10 illustrates a method for selectively dispensing one or more ingredients via a dispensing lid along with the rupturing knob.

FIG. 10 illustrates the method 1000 for selectively dispensing one or more ingredients via the lid along with the rupturing knob or rupturing member. In Step 1001, a disposable ingredient-dispensing lid comprising a base member, a rotatable ring element, is provided. In Step 1002, the rotatable ring element is selectively aligned to enclose one of the chambers underneath the rupturing knob. In Step 1003, rotating the rotating knob via the finger grip element. In Step 1004, the diaphragm of the enclosed chamber is ruptured. In Step 1005, the one or more ingredients from the enclosed chamber are dispensed.

Figure 11:
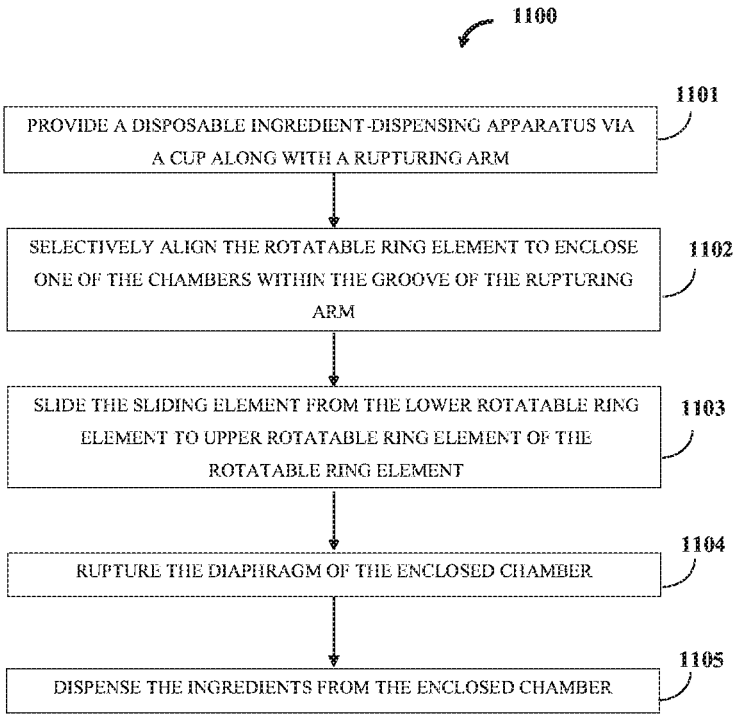
FIG. 11 illustrates a method for selectively dispensing one or more ingredients via a dispensing cup along with the rupturing arm.

FIG. 11 illustrates the method 1100 for selectively dispensing one or more ingredients via the cup along with the rupturing arm or rupturing member. In Step 1101, a disposable ingredient-dispensing cup comprising a sidewall, a rotatable ring element having at least one of an upper ring and a lower ring, is provided. In Step 1102, the rotatable ring element mounted to the sidewall is selectively aligned to enclose one of the chambers within the groove of the rupturing arm. In Step 1103, the sliding the sliding element from the lower rotatable ring element to upper rotatable ring element of the rotatable ring element. In Step 1104, the diaphragm of the enclosed chamber is ruptured. In Step 1105, the one or more ingredients from the enclosed chamber along the sidewall of the cup are dispensed into the cup.

Figure 12:
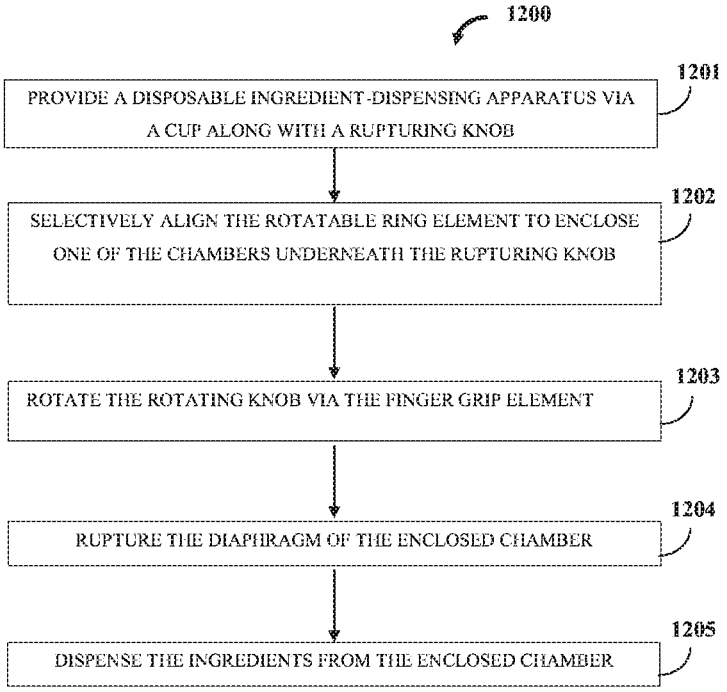
FIG. 12 illustrates a method for selectively dispensing one or more ingredients via a dispensing cup along with the rupturing knob.

FIG. 12 illustrates the method 1200 for selectively dispensing one or more ingredients via the cup along with the rupturing knob or rupturing member. In Step 1201, a disposable ingredient-dispensing cup comprising a sidewall, a rotatable ring element having at least one of an upper ring and a lower ring, is provided. In Step 1202, the rotatable ring element mounted to the sidewall of the cup is selectively aligned to enclose one of the chambers underneath the rupturing knob. In Step 1203, rotating the rotating knob via the finger grip element. In Step 1204, the diaphragm of the enclosed chamber is ruptured. In Step 1205, the one or more ingredients from the enclosed chamber along the sidewall of the cup are dispensed into the cup.

Figure 13:
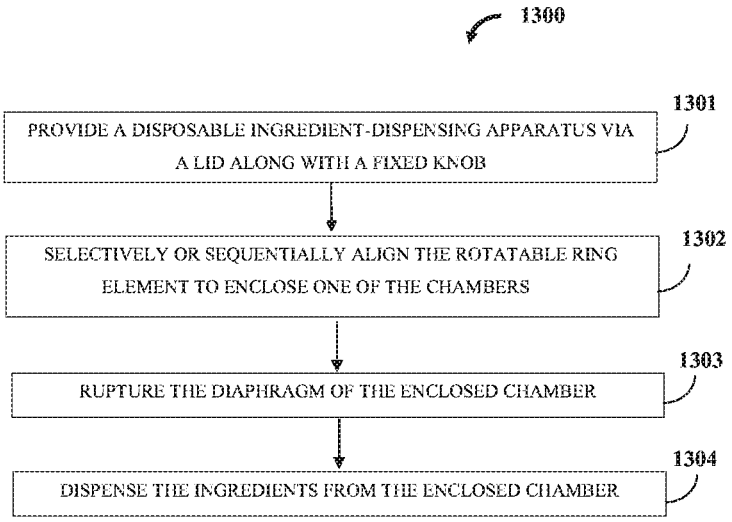
FIG. 13 illustrates a method for selectively dispensing one or more ingredients via a dispensing lid along with the fixed knob.

FIG. 13 illustrates the method 1300 for selectively dispensing one or more ingredients via the lid along with the fixed knob or rupturing member. In Step 1301, a disposable ingredient-dispensing lid comprising a base member, a rotatable ring element, is provided. In Step 1302, the rotatable ring element is selectively or sequentially aligned to enclose one of the chambers. In Step 1303, the diaphragm of the enclosed chamber is ruptured. In Step 1304, the ingredients from the enclosed chamber are dispensed into the container or cup.

Figure 14:
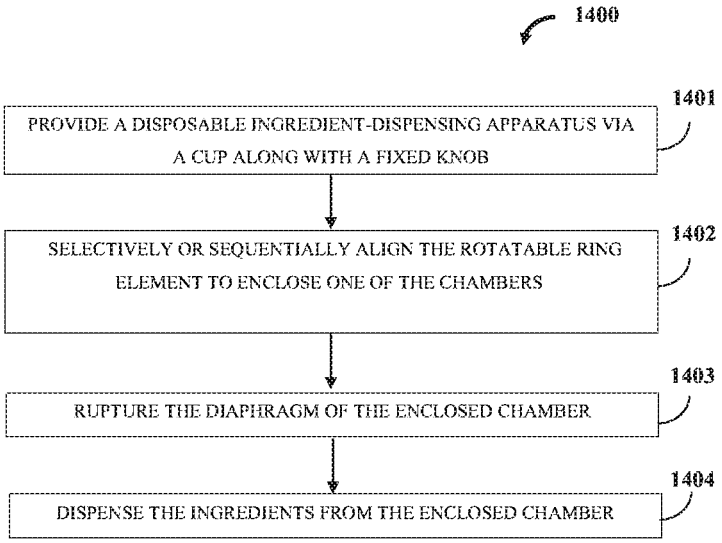
FIG. 14 illustrates a method for selectively dispensing one or more ingredients via a dispensing cup along with the fixed knob.

FIG. 14 illustrates the method 1400 for selectively dispensing one or more ingredients via the cup along with the fixed knob or rupturing member. In Step 1401, a disposable ingredient-dispensing cup comprising a sidewall, a rotatable ring element having at least one of an upper ring and a lower ring of the rupturing arm, is provided. In Step 1402, the rotatable ring element mounted to the sidewall of the cup is selectively or sequentially aligned to enclose one of the chambers. In Step 1403, the diaphragm of the enclosed chamber is ruptured. In Step 1404, the ingredients from the enclosed chamber along the sidewall of the cup are dispensed into the cup.

The foregoing description comprises illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A disposable ingredient-dispensing lid for selectively dispensing one or more ingredients, the disposable ingredient-dispensing lid comprising: a substantially circular base member comprising a huh, and plurality of chambers circumferentially positioned along the base member, wherein each chamber is filled with the one or more ingredients, and each chamber is sealed with a diaphragm, and a rotatable ring element mounted on the hub of the base member, configured to be rotatable circumferentially along a surface of the base member, wherein the rotatable ring element comprises a rupturing member positioned at a predefined section of the rotatable ring element, wherein the rotatable ring element is rotated to selectively align the rupturing member to enclose one of the chambers, wherein the rupturing member contacts the aligned chamber to rupture the diaphragm for selectively dispensing the one or more ingredients, wherein the rupturing member is a rupturing arm, and wherein the rupturing arm comprises a groove and a sliding element, and the sliding element seated in the groove is configured to slide from the hub of the base member towards the rotatable ring element to rupture the diaphragm for selectively dispensing the one or more ingredients.

2. The disposable ingredient-dispensing lid of claim 1, wherein the rotatable ring element is mounted on the hub of the base member via the rupturing arm radially extending from the hub of the base member to join the rotatable ring element.

* * * * *